United States Patent [19]

Niske et al.

[11] Patent Number: 4,651,895

[45] Date of Patent: Mar. 24, 1987

[54] SEALABLE DISPENSER FOR INDIVIDUAL MOISTENED TOWELETTES FROM A PERFORATED LENGTH THEREOF

[75] Inventors: Gerd E. Niske, 18 Randpark Drive, Randpark Ridge Ext 3; Albertus J. B. de Jongh, 324 Long Avenue, both of Randburg; Theunis J. Krüger, Krugersdorp, all of South Africa

[73] Assignees: Gerd Erwin Niske; Albertus Johannes Bernardus de Jongh, both of Randburg, South Africa

[21] Appl. No.: 574,423

[22] Filed: Jan. 27, 1984

[30] Foreign Application Priority Data

Jan. 26, 1983 [ZA] South Africa ..... 83/0514

[51] Int. Cl.[4] ..... B65D 83/00

[52] U.S. Cl. ..... 221/63

[58] Field of Search ..... 221/63; 222/545-546, 222/570

[56] References Cited

U.S. PATENT DOCUMENTS

| | | | |
|---|---|---|---|
| 3,762,612 | 10/1973 | Millr | 222/545 X |
| 4,017,002 | 4/1977 | Doyle et al. | 221/63 |
| 4,180,160 | 12/1979 | Ogawa et al. | 221/63 X |
| 4,328,907 | 5/1982 | Beard | 221/63 |

FOREIGN PATENT DOCUMENTS

| | | | |
|---|---|---|---|
| 0006709 | 1/1980 | European Pat. Off. . | |
| 0026319 | 4/1981 | European Pat. Off. . | |
| 2802443 | 1/1979 | Fed. Rep. of Germany . | |
| 8123069.9 | 12/1981 | Fed. Rep. of Germany . | |
| 1488447 | 6/1967 | France | 222/546 |
| 7921163 | 3/1980 | France . | |
| 1419167 | 12/1975 | United Kingdom | 221/63 |

*Primary Examiner*—Charles A. Marmor

*Attorney, Agent, or Firm*—Millen & White

[57] ABSTRACT

A dispenser for solvent wetted towelettes in the form of a continuous band that is perforated at intervals along its length to define separate towelettes. The dispenser comprises a container 12, a first closure member 16 having a skirt 22 that is received in an annular groove 24 in the container 12, and a lid 20 that screw engages the container 12. When the lid 20 is screwed on to the container 12 a first set of sealing formations 22 to 26 between the first closure member and the container and a second set of sealing formations 28 to 31 between the lid and first closure member are urged into sealing engagement. A further set of sealing formations 32, 34 adjacent a dispensing opening 18 are also urged into engagement. The dispenser has good sealing properties and is therefore suitable for use with volatile solvents such as acetone. Novel dispensing formations are also disclosed.

9 Claims, 8 Drawing Figures

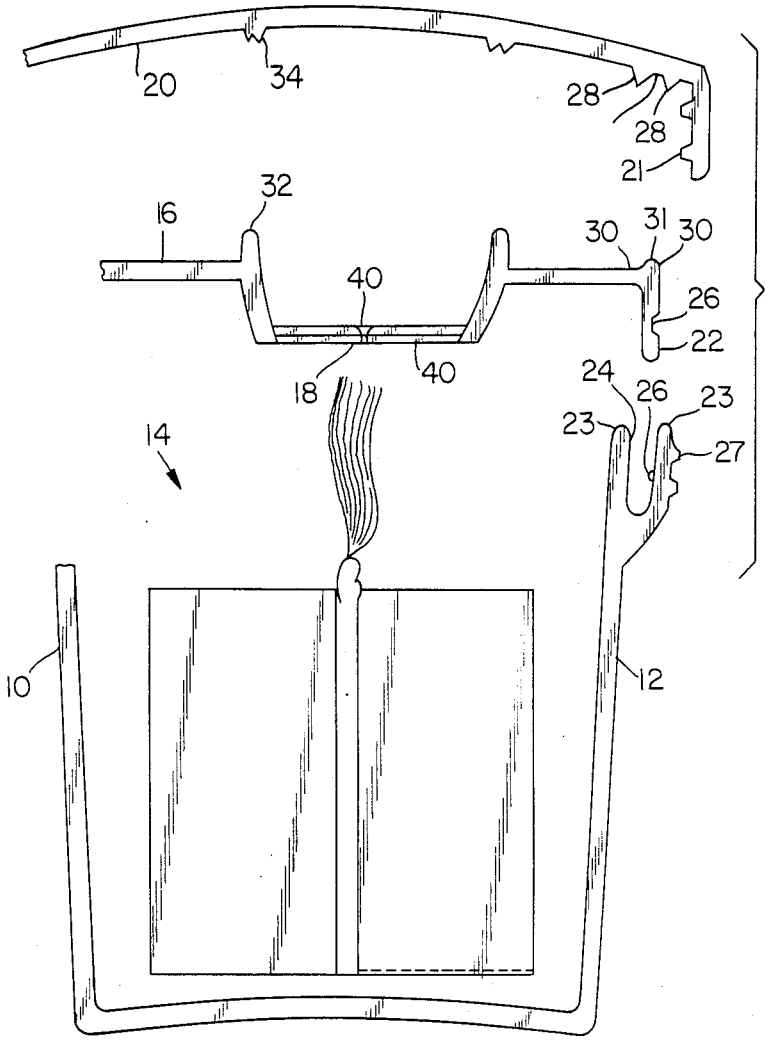
FIG. 1
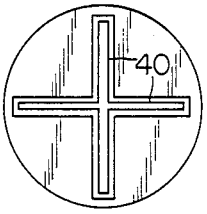
FIG. 2
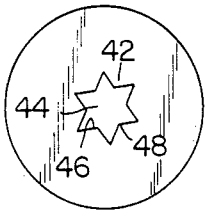
FIG. 3
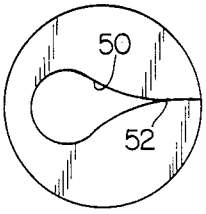
FIG. 4
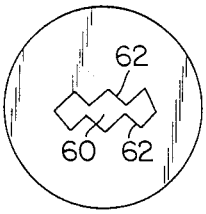
FIG. 5
FIG. 7
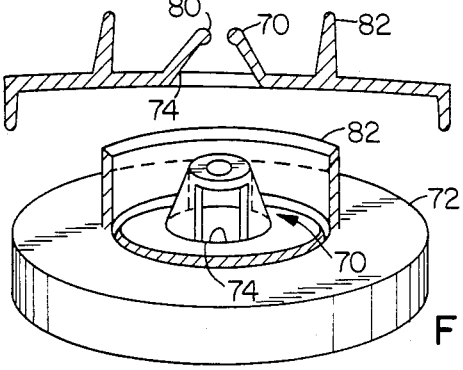
FIG. 6
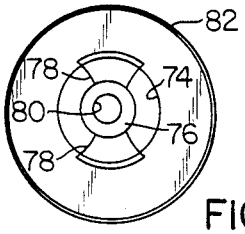
FIG. 8

SEALABLE DISPENSER FOR INDIVIDUAL MOISTENED TOWELETTES FROM A PERFORATED LENGTH THEREOF

FIELD OF THE INVENTION

This invention relates to containers in general and more particularly to a dispenser of the kind for dispensing moist towelettes from a stock contained in the dispenser.

BACKGROUND TO THE INVENTION

Many proposals for storing and dispensing moist or wet towelettes have been disclosed in the Patent Literature. U.S. Pat. No. 4,017,002 Doyle et al discloses a typical example for dispensing a roll of material perforated at intervals along its length to define towelettes. The dispenser comprises a cylindrical container for the roll, a closure for the container and formed with a slit through which the towelettes are dispensed and a cap which clips to the closure to cover the slit. The closure and slit are such that on drawing the moist material through the slit, a towelette will separate from the material after a leading portion of the subsequent towelette has been drawn through the slit where it may be grasped by a user. U.S. Pat. No. 3,749,296 Harrison discloses a similar dispenser with the slit being formed in a portion of the closure at an angle to the general plane of the closure. U.S. Pat. No. 3,841,466 Hoffman et al discloses a variant for dispensing a continuous stack of the towelettes. A thin, plastics membrane is provided for initial sealing of the dispensing opening, until broken for use, and for forming a seal between a peripheral rib on a hinged lid and a channel formed in the container to receive the rib. Variations of the dispensing opening are disclosed in the U.S. Pat. Nos. 3,836,044 Tilp et al and 3,780,908 Fitzpatrick et al which have a diamond-shaped opening with a movable barrier member, the towelettes being separate and interleaved in a stack.

These prior proposals while being suitable for non-volatile liquids for wetting the towelettes are not appropriate for volatile liquids such as acetone or alcohol or other solvents. U.S. Pat. No. 3,991,895 teaches a moisture proof container having a lid with an internal, annular plastics skirt which resiliently seals against a sharp edged annular formation inside the mouth of the container. This construction however is not suitable for solvent wetted towelettes because of the large exposed evaporation surfaces when the lid is removed. The Fitzpatrick patent mentioned above contemplates the use of non-water based moistening or wetting liquids, but is concerned with the problem of dispensing towelettes moistened with these liquids from stacks and not with providing an effective seal for volatile solvents.

An object of this invention is to provide a container, particularly though not exclusively, for dispensing towelettes from a stock of towelette material which is suitable at least for partially volatile wetting liquids for the towelettes.

SUMMARY OF THE INVENTION

According to the invention there is provided a dispenser including a container having an open end; a first closure member engaged with the container for closing the open end and having a dispensing formation for dispensing towelettes from the container such that on withdrawal of a towelette through the dispensing formation the leading edge of the succeeding towelette is drawn through the opening; and a second closure member removably attached to the container member by securing formations on the second member and container, with the first closure member being positioned in a space defined inside the second closure member and the container when they are engaged with each other, characterised in that there is a first set of sealing formations for sealing the first closure member to the container and a second set of sealing formations for sealing the first closure member to the second closure member, with at least the second set of sealing formations being urged into sealing engagement when the second closure member is engaged with the container and a third set of sealing formations spaced from the first two sets and surrounding the dispensing formation for sealing the first closure member to the first closure member.

The first closure member may be permanently engaged with the container or may frictionally engage or clip into engagement with the container. In a preferred configuration, the first closure member includes a depending rib or skirt which fits into a peripheral groove at the open end of the container. This rib and groove formation constitutes a preferred form of the first set of sealing formations. The peripheral groove may converge inwardly from its open end so that the rib or skirt can sealingly engage the walls of the groove on being urged into the groove when the second closure member is secured to the container. Locating formations preferably are formed on the rib or skirt and the portions of the container defining the groove for locating the first closure member with respect to the container.

The second closure member may be secured to the container by either clipping or screwing to the container, suitable formations on the container and the second closure member being provided for this purpose. These formations are arranged to ensure that when the second closure member is engaged with the container, the sealing formations are urged into sealing engagement.

The second set of sealing formations, i.e. for sealing the first and second closure members to each other, may be opposing surface formations which surround the dispensing formation defined by the first closure member and which are urged to abut each other when the second closure member is secured to the container. Preferably at least one of the formations is a rib and more preferably the other of the formations defines a groove for receiving the rib to facilitate or ensure sealing engagement.

The third set of sealing formations is provided adjacent the dispensing opening in a central region of the first and second closure members where there is flexibility of at least one of the closure members so that when closed there is a degree of resiliant bias urging these formations into sealing engagement.

The dispenser including the container and closure members may be of any suitable material though appropriate synthetic plastics are preferred. Preferably, the container and second closure member are of a suitably polypropylene and the first closure member is selected from low-density polyethylene, Nylon and the like.

The towelettes may be of any suitable material.

The liquid within the container may be a nail polish remover, such as acetone and the like, which are volatile with a high vapour pressure and with which leakage could be dangerous and damaging. Thus an aspect of the invention extends to a dispenser as described above containing a stock of towelettes and a solvent which is at least partially volatile, such as a liquid nail polish remover, moistening the towelettes. Any appropriate solvent or cleaning agent could be used. Other liquids that may be contained in the container may be makeup remover, disinfectants, liquid soaps, detergents and the like.

BRIEF DESCRIPTION OF THE DRAWINGS

Preferred embodiments of the invention are now described, by way of example, with reference to the accompanying schematic drawings, in which:

FIG. 1 shows an exploded, partial, cross-sectional view of a dispenser of the invention containing a roll of towelette material;

FIG. 2 shows a plan view of part of the dispenser of FIG. 1 illustrating the dispensing formation;

FIGS. 3 to 5 show plan views similar to FIG. 2 of variants of dispensing formations; and FIGS. 6 to 8 show respectively partial perspective, cross-sectional and plan views of a preferred dispensing formation.

DESCRIPTION OF PREFERRED EMBODIMENTS

FIG. 1 shows a dispenser 10 including a container 12 having an open end 14, a first closure member or barrier 16 engageable with the container 12 and a second closure member or lid 20 also engageable with the container. The barrier 16 has a dispensing formation 18 in a central region through which towelettes from a perforated roll 19 contained in the container can be dispensed as is described below. The second closure member 20 screws into engagement with the container in order to seal the dispenser 10 as described below.

The container 12 is cylindrical with a slight taper downwardly.

Barrier 16 has a depending lip or skirt 22 which can frictionally fit into a peripheral groove 24 formed in the container at the open end 14 to close off the open end. The groove 24 converges slightly from its open end so that by urging the lip 22 of the barrier 16 into the groove a seal is formed. Complementary locating formations 26 in the form of a peripheral rib on one wall of the groove 24 and a complementary peripheral groove formed in the lip 22 are provided for clipping the barrier 16 into engagement with the container.

The dispensing formation 18 (see FIG. 2) is in the form of crossing slits 40 through which the material of the roll 19 can be pulled, while individual towelettes separate from the roll at the perforations but only after a portion of the next towelette has been exposed for grasping through the slit. This technique of dispensing towelettes is already known.

The second closure member or lid 20 has internal threads 21 that screw engage thread formations 27 on the container 12. When the lid is screwed into engagement with the container annular ribs 28 on the lid straddle and sealingly engage an annular rib 30 on the barrier 16. At the same time the lip 22 is urged into the groove 24, thereby ensuring proper sealing between the barrier and the container. Thus an annular seal surrounding the dispensing formation 18 is formed to inhibit any leakage from the container 12 via the dispensing formation and then between the barrier and lid.

An upwardly projecting annular rib 32 adjacent the dispensing opening 18 is provided to engage an opposing formation 34 projecting from the lid 20 when the lid is screwed on to the container. The formations 32 and 34 are formed further to inhibit leakage of liquid from the dispenser.

The first closure member or barrier 16 is of low-density polyethylene which is resiliently flexible so that when the dispenser is closed, the formations 32 and 34 resiliently engage one another. The container 12 and the lid 20 are of an appropriate polypropylene.

By screwing the lid 20 tightly to the container 12 effective sealing of the dispenser is ensured. All of the sealing formations described above serve as seals when the lid is tightly engaged with the container.

The dispenser is particularly suitable for towelettes moistened or saturated with a nail polish remover and the like volatile material which would otherwise normally evaporate. Moreover, leakage of such volatile liquids for example solvents may be dangerous and damaging.

FIG. 3 shows a dispensing opening 42 comprising a central opening 44 with radiating, tapering fingers 46 defined between triangular tangs 48 which are dimensioned and shaped to provide the required resistance for automatically separating towelettes at the desired position described above.

FIG. 4 shows a tear-drop or pear-shaped opening 50 which tapers at its narrow end to a slit 52. The wide part of the opening facilitates initial threading, while the slit is used for separating towelettes in use.

FIG. 5 shows an opening 60 formed by opposed serrations or zig-zags. The function of this opening is similar to that of the others described above.

FIGS. 6 to 8 which are each partial or partly sectioned views show a dispensing formation 70 formed on the barrier member 72 which has a substantially planar upper surface. The formation 70 comprises a circular hole 74 in the member 72, a ring 76 spaced above the hole 74 by opposed legs 78 and defining a second hole 80 of smaller diameter and area than the hole 74. A circular wall 82 similar to the wall 32 of FIG. 1 surrounds the formation 70.

In use the leading edge of a first towelette is threaded through the holes 74 and 80. The towelette is frictionally engaged with the ring 76 and engaged with less resistance by the walls of the hole 74. The hole 76 acts as described above for separating towelettes in use. However, should the towelette separate from the succeeding or "next" towelette such that a leading edge of the next towelette cannot be grasped or falls back through the hole 80, then the "next" towelette will still be held by the walls of the hole 74. Thus, the "next" towelette remains exposed and by using a suitable rod or pen, not shown, can be pushed upwards through the hole 80.

In a modification of the example shown in FIGS. 6 to 8, the hole 80 may be off-set from the hole 74. The axes of the holes 74 and 80 may be inclined or perpendicular rather than parallel as shown; having the axis of the hole 80 substantially parallel to the general plane of the barrier 72 has the benefit that it will provide different resistances whether pulled parallel to or normal to the plane of the barrier 72.

The dispenser 10 may also be used with other liquids, such as make-up removers, liquid soaps, disinfectants, detergents and the like. The towelettes may be of any suitable material, their suitability being determined by the use to which they are intended and the solvent with which they will be used. The dispensing openings may assume shapes other than those illustrated in the drawings and described above and may include an internal flap.

The claims which follow are to be regarded as an integral part of the present disclosure.

We claim:

1. A dispenser for dispensing individual moistened towelettes from a length of towelette material having spaced transverse separation lines, the dispenser including a container with an open end for containing the length of towelete material; a barrier member engaged with the container and closing the open end; a dispensing formation in the barrier member for dispensing the towelettes such that on withdrawal of a towelette through the dispensing formation a leading edge portion of the succeeding towelette is drawn through and engaged by the dispensing formation while the first mentioned towelette is separated from the length thereof by the application of forces for withdrawing the towelette and opposing resistive forces provided by the dispensing formation; and a lid member removably attached to the container by complementary formations on the lid member and the container with the improvement being characterized in that the dispensing formation comprises:

(a) a first opening formation being dimensioned to frictionally engage a towelette passing therethrough with sufficient force to prevent the towelette falling through the opening;

(b) a second opening formation being spaced from the first opening formation and being dimensioned to frictionally engage a towelette with a force in combination with the force provided by the first opening formation sufficient to cause the separation of the towelette from a length thereof when a leading edge of a succeeding towelette is exposed through the second opening formation and dimensioned also normally to hold said leading edge in said exposed position, the opening formations being arranged such that in use the towelette material passes first through the first and then through the second opening formation; and (c) support means holding the second opening formation in said spaced position.

2. A dispenser of claim 1, wherein at least one opening is formed in said support means to permit lateral access to the first opening formation.

3. A dispenser of claim 1, in which each of the opening formations is of substantially fixed cross-section during use.

4. A dispenser of claim 1, in which the first and second opening formations are each substantially circular.

5. A dispenser of claim 1, wherein the second opening formation is of smaller area than that of the first opening formation and the support means tapers from the first to the second opening formation.

6. A dispenser of claim 1, in which the first opening formation is formed in the barrier member with the second opening formation being positioned outside the space defined by said container and barrier member.

7. A dispenser for dispensing individual moistened towelettes from a length of towelette material having spaced transverse separation lines, the dispenser including a container with an open end for containing the length of towelette material; a barrier member engaged with the container and closing the open end; a dispensing formation in the barrier member for dispensing the towelettes such that on withdrawal of a towelette through the dispensing formation a leading edge portion of the succeeding towelette is drawn through and engaged by the dispensing formation while the first mentioned towelette is separated from the length thereof by the application of forces for withdrawing the towelette and opposing resistive forces provided by the dispensing formation; and a lid member removably attached to the container by complementary formations on the lid member and the container, wherein the improvement is characterized by:

(a) the barrier member being of a resiliently flexible material and having a body in the form of a disc;

(b) the barrier member having a peripheral skirt which firmly engages in a complementary groove formation at the open end of the container, the groove and skirt tapering from the open end of the groove and including interengaging locating formations to prevent separation of the barrier member and container when a towelette is being withdrawn through the dispensing formation and separated from the length of towelette material, with the engagement of the skirt and the container forming a first sealing formation;

(c) the lid member engaging the container by means of complementary screw threaded formations;

(d) an outer annular rib formation being provided on at least one of the barrier member and lid member at a position substantially in alignment with the peripheral skirt on the barrier member, the rib being dimensioned such that when the lid member is screwed into engagement with the container (a) sealing contact is obtained between the lid and barrier members substantially at the periphery of the barrier member thereby forming a second sealing formation and (b) a force is provided to urge the aforesaid skirt against the container in a direction to ensure the effectiveness of the first sealing formation;

(e) an inner annular rib formation being provided on at least one of the barrier member and the lid member at a position substantially central with respect to and spaced from the periphery of the barrier member where the disc body is capable of significant deflection and providing a third sealing formation surrounding the dispensing opening when the lid member is engaged with the container, the lid member, barrier member and inner rib formation forming a restricted space for containment of vapor evaporated from the moistened towelette material.

8. A dispenser of claim 7, in which the dispensing opening is normally not sealed.

9. A dispenser of claim 7, in which an inner annular rib formation is provided on each of the lid and barrier members.

* * * * *